US009467784B2

(12) United States Patent
Huang et al.

(10) Patent No.: US 9,467,784 B2
(45) Date of Patent: Oct. 11, 2016

(54) PIEZOELECTRIC-TYPE SPEAKER

(71) Applicant: Jetvox Acoustic Corp., Taoyuan (TW)

(72) Inventors: To-Teng Huang, Taoyaun (TW); Ming-Fang Hung, Taoyuan (TW)

(73) Assignee: JETVOX ACOUSTIC CORP., Taoyuan (TW)

( * ) Notice: Subject to any disclaimer, the term of this patent is extended or adjusted under 35 U.S.C. 154(b) by 0 days.

(21) Appl. No.: 14/612,654

(22) Filed: Feb. 3, 2015

(65) Prior Publication Data

US 2015/0373460 A1 Dec. 24, 2015

(30) Foreign Application Priority Data

Jun. 18, 2014 (TW) ..... 103210747 U

(51) Int. Cl.

| | |
|---|---|
| ***H04R 25/00*** | (2006.01) |
| ***H04R 17/00*** | (2006.01) |
| ***H04R 1/02*** | (2006.01) |
| ***H04R 1/10*** | (2006.01) |
| ***H04R 1/24*** | (2006.01) |
| ***H04R 1/26*** | (2006.01) |
| ***H04R 1/28*** | (2006.01) |

(52) U.S. Cl.

CPC ..... *H04R 17/00* (2013.01); *H04R 1/02* (2013.01); *H04R 1/1075* (2013.01); *H04R 1/24* (2013.01); *H04R 1/26* (2013.01); *H04R 1/28* (2013.01)

(58) Field of Classification Search

CPC ..... H04R 1/24; H04R 1/26; H04R 17/00
See application file for complete search history.

(56) References Cited

U.S. PATENT DOCUMENTS 4,078,160 A * 3/1978 Bost ..... B06B 1/0603 310/331
4,418,248 A * 11/1983 Mathis ..... H04R 1/26 381/190
6,356,642 B1 3/2002 Nakamura et al.
8,098,854 B2 * 1/2012 van Halteren ..... H04R 1/24 381/182

(Continued)

FOREIGN PATENT DOCUMENTS

| | | |
|---|---|---|
| CN | 203378015 U | 1/2014 |
| EP | 2 101 512 A1 | 9/2009 |

(Continued)

OTHER PUBLICATIONS

Office Action, issued by EPO on May 11, 2015 in application No. 15156930.8-1910 (1-6 pages).

*Primary Examiner* — Curtis Kuntz
*Assistant Examiner* — Ryan Robinson
(74) *Attorney, Agent, or Firm* — Muncy, Geissler, Olds & Lowe, P.C.

(57) ABSTRACT

A piezoelectric-type speaker is provided for converting electrical signals into sounds capable of being heard by a human ear. The piezoelectric-type speaker includes a housing, a separating portion, a supporting base, a high-pitched speaker and a dynamic low-pitched speaker. The separating portion is disposed at the housing and provided for separating interior spaces of the housing. The supporting base is disposed at the housing. One end of the supporting base is fastened with the separating portion. The high-pitched speaker is formed by a piezoelectric member, and is supported by the other end of the supporting base. The dynamic low-pitched speaker is disposed in the housing. The dynamic low-pitched speaker is disposed at the separating portion and opposite the high-pitched speaker.

7 Claims, 11 Drawing Sheets

(56) References Cited

U.S. PATENT DOCUMENTS 8,515,103 B2 * 8/2013 Mei ..... H04R 1/1016 381/309
8,757,317 B1 * 6/2014 Wang ..... H04R 1/345 181/153
8,774,447 B2 * 7/2014 Ko ..... H04R 19/02 381/150
8,873,790 B2 * 10/2014 Hayashida ..... H04R 1/1016 381/370
8,948,423 B2 * 2/2015 Kim ..... H04R 1/24 381/182
2005/0271238 A1 * 12/2005 Kobayashi ..... H04R 1/24 381/398
2011/0051981 A1 * 3/2011 Lehdorfer ..... H04R 1/1075 381/380
2012/0087532 A1 * 4/2012 Yang ..... H04R 1/10 381/380

FOREIGN PATENT DOCUMENTS

JP 2004-147077 A 5/2004
KR 20040110982 A 12/2004
WO WO 2011/052521 A1 5/2011

* cited by examiner

10

200

400

400

PIEZOELECTRIC-TYPE SPEAKER

CROSS-REFERENCES TO RELATED APPLICATIONS

This non-provisional application claims priority under 35 U.S.C. §119(a) on Patent Application No. 103210747 filed in Taiwan, R.O.C. on 2014, Jun. 18, the entire contents of which are hereby incorporated by reference.

BACKGROUND

1. Technical Field

The disclosure relates to a speaker, and particularly to a piezoelectric-type speaker.

2. Related Art

A speaker is an electro-acoustic transducer capable of converting electrical energy into acoustic energy through physical effects. According to different physical effects being applied, the speaker is divided into several types, such as electromagnetic-type speaker, piezoelectric-type speaker, capacitive speaker, and electrodynamic-type speaker. Along with the rapid developments of related technologies, the trend for designing electronic devices is to reduce weight and miniaturize, so people can use the electronic device and the portable stereo earphone anytime and anywhere. When the electronic device plays sounds using the earphone, the original acoustic frequency is converted into a converted acoustic frequency which the user can hear.

The conventional earphone includes a piezoelectric member for reproducing the acoustic frequency in the high-pitched region; additionally, the conventional earphone includes a low-pitched speaker provided for reproducing the acoustic frequency in low-pitched region. Such piezoelectric-type earphone have a lower cost because of the cheaper piezoelectric members used, in contrast to the balance armature speaker (BA speaker). However, conventionally the piezoelectric member is assembled to the low-pitched annular structure, and the high-pitched speaker with piezoelectric member cannot obtain the harmonic oscillation frequency required. Furthermore, upon playing the high-pitched sounds and low-pitched sounds, the crossing point (frequency division point), between the high-pitched speaker and the low-pitched speaker, overlaps with the sounds which are playing, thereby reducing the quality of the sound output by the conventional earphone.

SUMMARY

In view of this, the disclosure provides a piezoelectric-type speaker provided for converting electrical signals into sounds capable of being heard by a human's ear. The piezoelectric-type speaker includes a housing, a separating portion, a supporting base, a high-pitched speaker and a dynamic low-pitched speaker. The separating portion is disposed at the housing and provided for separating interior spaces of the housing. The supporting base is disposed at the housing. One end of the supporting base is fastened with the separating portion. The high-pitched speaker is formed by a piezoelectric member and is supported by the other end of the supporting base. The dynamic low-pitched speaker is disposed in the housing. The dynamic low-pitched speaker is disposed at the separating portion ad opposite to the high-pitched speaker.

Based on this, in the disclosure, one end of the supporting base is fastened with the housing, and the other end of the supporting base is provided to support the high-pitched speaker. Additionally, the high-pitched speaker includes the piezoelectric member, thereby allowing the piezoelectric-type speaker to provide required resonant frequencies and high quality sounds. Although the high-pitched speaker is sealed, the acoustic pressure thereof is not reduced, and the piezoelectric member ensures the quality of the output acoustic pressure. Furthermore, the volume of the low-pitched sounds output by the film structure and passing through the through holes and the low-pitched adjusting orifices becomes smaller near the crossing point, so the piezoelectric-type speaker of the disclosure outputs clear sounds within a wider acoustic band.

The detailed features and advantages of the disclosure are described below in great detail through the following embodiments, the content of which is sufficient for those skilled in the art to understand the technical content of the disclosure and to implement the disclosure there accordingly. Based upon the content of the specification, the claims, and the drawings, those skilled in the art can easily understand the relevant objectives and advantages of the disclosure.

BRIEF DESCRIPTION OF THE DRAWINGS

The disclosure will become more fully understood from the detailed description, given herein below for illustration only and thus not limitative of the disclosure, wherein.

DETAILED DESCRIPTION

Figure 1:
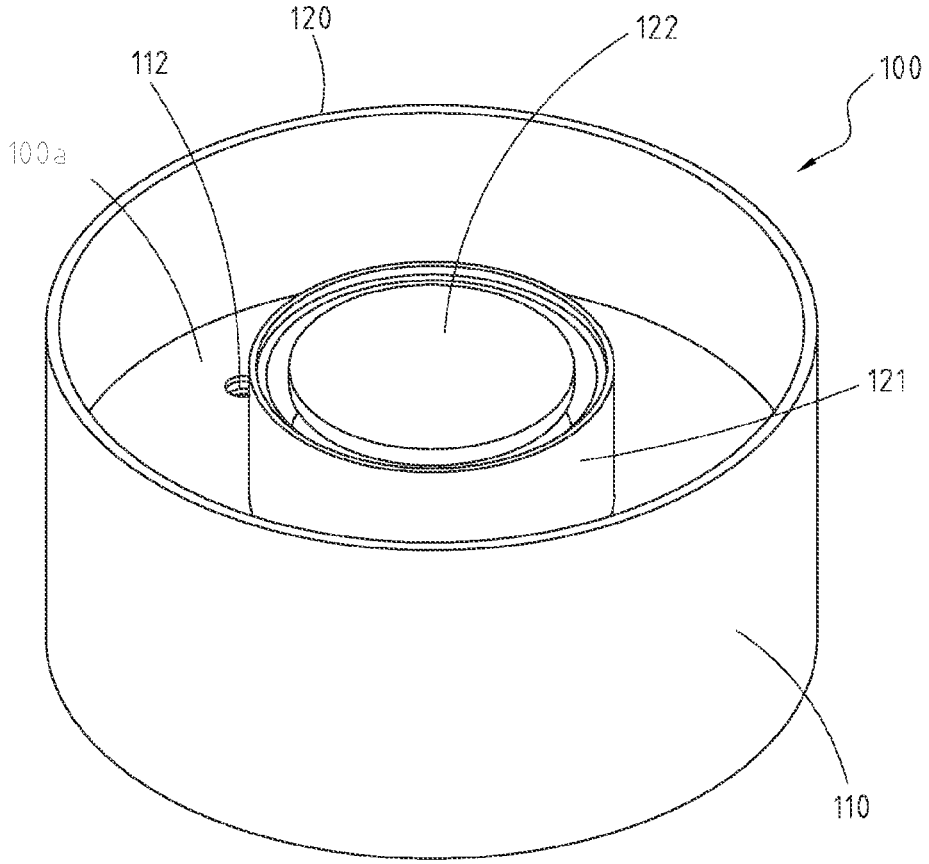
FIG. 1 is a perspective view of a piezoelectric-type speaker of one embodiment of the disclosure.
Figure 2A:
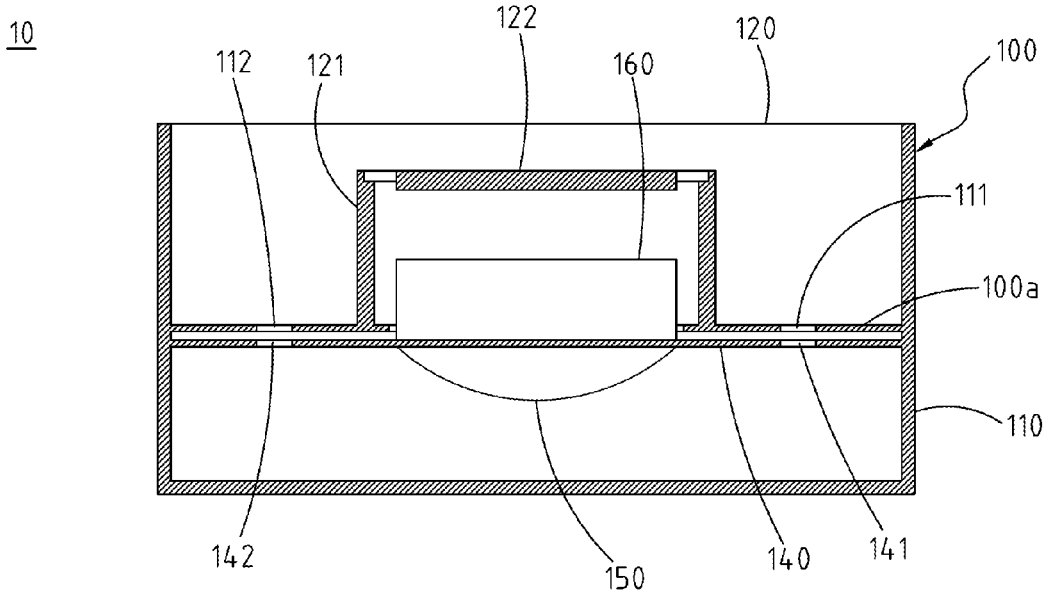
FIG. 2A is a sectional view of the piezoelectric-type speaker of one embodiment of the disclosure.
Figure 2B:
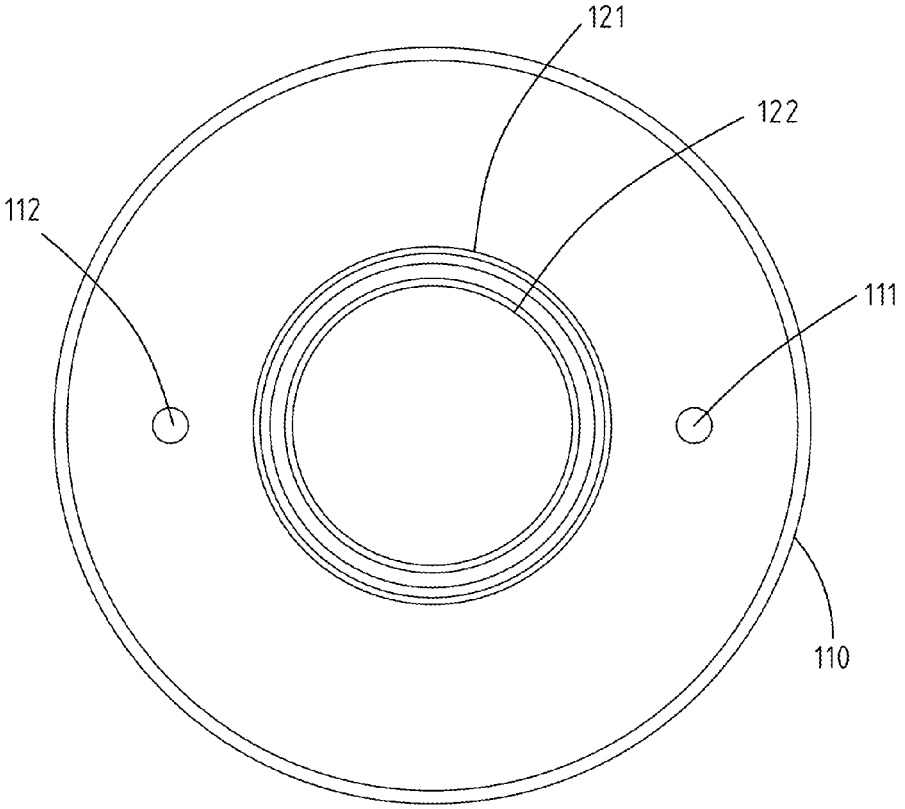
FIG. 2B is a top view of the piezoelectric-type speaker of one embodiment of the disclosure.

FIG. 1 is a perspective view of a piezoelectric-type speaker 10 of one embodiment of the disclosure, FIG. 2A is a sectional view thereof, and FIG. 2B is a top view thereof. Please refer to FIG. 1, FIG. 2A and FIG. 2B, in which the piezoelectric-type speaker 10 is provided to convert electrical signal output by the media player or by the receiver, into sounds which are capable of being heard by humans. The piezoelectric-type speaker 10 utilizes the electro-acoustic transducer. The piezoelectric-type speaker 10 includes a film structure 150 (for moving-coil speaker unit), and a high-pitched speaker (piezoelectric-type). The piezoelectric-type speaker 10 can be applied to earbud, headphone, or other acoustic reproducing device (such as audio equipment). The piezoelectric-type speaker 10 includes a housing 100, a separating portion 100*a*, a supporting base 121, a high-pitched speaker 122 and a dynamic low-pitched speaker.

The housing 100 is formed as a box and includes a lower housing 110 and an upper housing 120. The separating portion 100*a* is fastened at the inner surface of the housing 100. The separating portion 100*a* is disposed at an interior space of the housing 100 and formed as a plate to be parallel with the bottom surface of the housing 100. The separating portion 100*a* divides the interior space into upper and lower spaces. Furthermore, a plurality of low-pitched adjusting orifices 111, 112 opened on two sides of the separating portion 100*a*. Here, the diameter of the housing 100 is approximately equal to 30 mm. Additionally, the housing 100 includes a frame 140; the frame 140 is fastened at an inner wall of the lower housing 110, and the frame 140 is disposed below the separating portion 100*a* and parallel to the separating portion 100*a*. A plurality of through holes 141, 142 is opened on two sides of the frame 140 and corresponds to the low-pitched adjusting orifices 111, 112 respectively.

The supporting base 121 is a cylinder structure. One of two ends of the supporting base 121 is fastened with the separating portion 100*a*. The low-pitched adjusting orifices 111, 112 are arranged at two sides of the supporting base 121. Here, the diameter of the supporting base 121 is approximately equal to 10 mm.

The high-pitched speaker 122 is a disk structure and is provided for outputting high-pitched sounds (5 kHz-45 kHz). Here, the high-pitched speaker 122 is formed by a piezoelectric member. The high-pitched speaker 122 is supported by the other end of the supporting base 121 and is in a sealed state. Although the high-pitched speaker 122 is sealed, the acoustic pressure thereof is not reduced. Additionally, the resonant frequency of the high-pitched speaker 122 is preferably within a range of 5 kHz to 7 kHz. Here, the diameter of the high-pitched speaker 122 is approximately equal to 9 mm; specifically, the size of the supporting base 121 is slightly larger than that of the high-pitched speaker 122. Please refer to FIG. 5A, in which embodiment the high-pitched speaker 122 is supported at the other end of the supporting base 121 by a plurality of supporting portions 280, 281; furthermore, by adjusting the distance between the supporting portions 280, 281, the acoustic frequency (the resonant frequency), to be output can be changed.

The dynamic low-pitched speaker includes a film structure 150 and a low-pitched speaker unit 160. The film structure 150 is disposed in the housing 100. The film structure 150 is disposed at the separating portion 100*a* and opposite to the high-pitched speaker 122. Here, the film structure 150 is provided for outputting low-pitched sounds (20 Hz-5 kHz). The low-pitched speaker unit 160 is disposed at an interior of the supporting base 121 and adjacent to one end of the supporting base 121. The low-pitched speaker unit 160 is disposed at the separating portion 100*a* and corresponds to the film structure 150.

The operation of the low-pitched speaker unit 160 drives the film structure 150 to vibrate. Upon the film structure 150 being vibrating, the low-pitched sounds passes through the low-pitched speaker unit 160 and the space below the frame 140 so as to be output. Furthermore, after passing through the through holes 141, 142 of the frame 140, the low-pitched sounds further enter into the upper housing 120 through the low-pitched adjusting orifices 111, 112 to be output to the surrounding or the user. Here, the volume of the low-pitched sounds is adjustable based on the size or the number of the low-pitched adjusting orifices 111, 112. Additionally, by increasing the diameters of the low-pitched adjusting orifices 111, 112, the volume of the low-pitched sounds can be increased. Upon outputting the low-pitched sounds, the fundamental frequency (F0) is tuned lower, to the low-pitched frequency band. Furthermore, via combining the lower housing 110 and the upper housing 120, the low-pitched speaker unit 160 and the film structure 150 are sealed in the housing 100, and the low-pitched sounds can be reproduced via such sealing.

The acoustic band of the film structure 150 and that of the high-pitched speaker 122 have an overlapped region (called crossing point or frequency division point), the crossing point between the film structure 150 and the high-pitched speaker 122 is approximately at a range from 3 kHz to 5 kHz); that is, when a signal in the range of 3 kHz to 5 kHz is inputted, sounds will generate from the film structure 150 and the high-pitched speaker 122. Because the low-pitched sounds pass through the through holes 141, 142 and the low-pitched adjusting orifices 111, 112, the low-pitched sounds can cut off sounds the frequency of which are higher than 5 kHz much easier; that is, the volume of the low-pitched sounds output by the film structure 150 and passing through the through holes 141, 142 and the low-pitched adjusting orifices 111, 112 becomes smaller near the crossing point, thus the piezoelectric-type speaker 10 of the disclosure outputting clear sounds in a rather wider acoustic band.

Figure 3A:
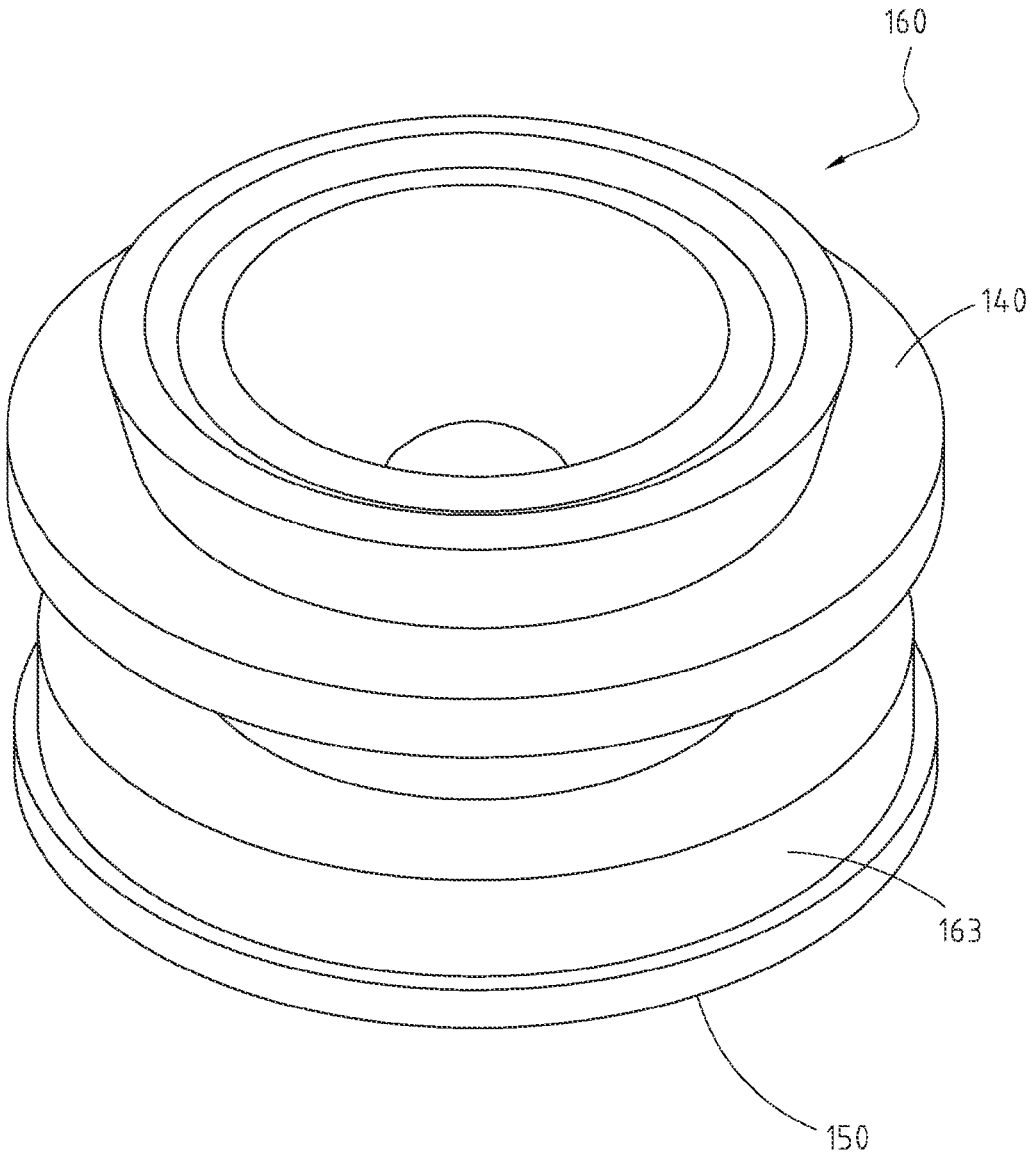
FIG. 3A is a perspective view of a low-pitched speaker unit of the piezoelectric-type speaker of the disclosure.
Figure 3B:
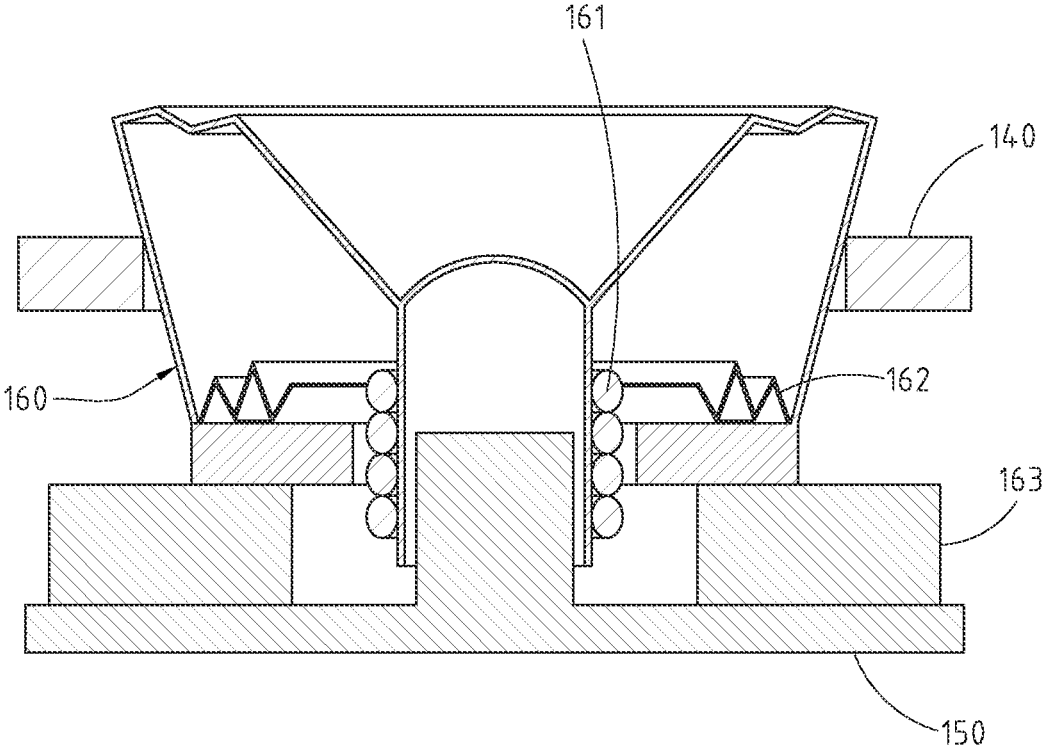
FIG. 3B is a sectional view of the low-pitched speaker unit of the piezoelectric-type speaker of the disclosure.

FIG. 3A is a perspective view of the low-pitched speaker unit 160 of the piezoelectric-type speaker 10, and FIG. 3B is a sectional view thereof. Please refer to FIG. 3A and FIG. 3B, in which the low-pitched speaker unit 160 includes a voice coil 161, a damper 162 and a magnet 163. The voice coil 161 is formed by a copper wire structure. The voice coil 161 is winded onto a voice coil framework which is disposed on the film structure 150. Along with the vibration of the film structure 150, the voice coil 161 is stretched and retracted up and down. In this embodiment, the damper 162 is formed as a folded plate; one of two ends of the damper 162 is connected to the frame 140, and the other end of the damper 162 is connected to the voice coil 161. Additionally, the frame 140 can be formed as a tunnel-shaped structure. The magnet 163 is an annular magnet body and can be a cobalt magnet body or a ferrite magnet body. The magnet 163 is disposed on the film structure 150 and sleeved with a centre rod protruded from the film structure 150.

Figure 4A:
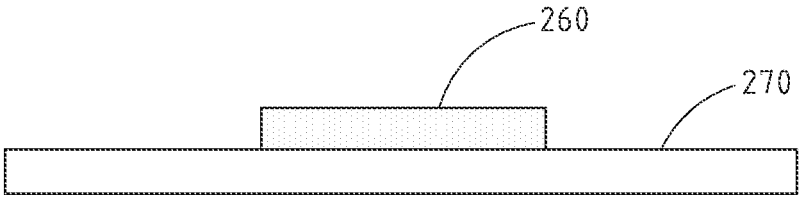
FIG. 4A is a schematic view (1) to illustrate the manufacturing process of a piezoelectric member of the piezoelectric-type speaker of the disclosure.

FIG. 4A is a schematic view (1) to illustrate the manufacturing process of the piezoelectric member 260 of the piezoelectric-type speaker 10. Please refer to FIG. 4A, which illustrates the enlarged view of the high-pitched speaker 122 and the piezoelectric member 260 thereof in FIG. 2A. In this embodiment, the high-pitched speaker 122 includes a vibration plate 270 and the piezoelectric member 260 to form a single piezoelectric chip. It is realized that in FIG. 4A, some electric components on the vibration plate 270 are omitted, such as the resistance, the transistor or the oscillation circuit. The vibration plate 270 is formed by resin or metal, and the piezoelectric member 260 is attached to the vibration plate 260. Additionally, the piezoelectric member 260 is formed by PZT material. Here, the piezoelectric member 260 is attached to the surface of the vibration plate 270, but embodiments are not limited thereto; in some implementation aspects, the piezoelectric member 260 is attached to the back of the vibration plate 270. Alternatively, two layers of the piezoelectric member 260 are attached to the surface of the vibration plate 270, and other two layers of the piezoelectric member 260 are attached to the back of the vibration plate 270, so that four layers of the piezoelectric member 260 are disposed on the vibration plate 270, but embodiments are not limited thereto.

Figure 4B:
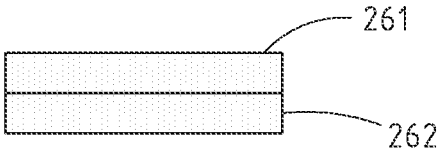
FIG. 4B is a schematic view (2) to illustrate the manufacturing process of the piezoelectric member of the piezoelectric-type speaker of the disclosure.

FIG. 4B is a schematic view (2) to illustrate the manufacturing process of the piezoelectric members 261, 262 of the piezoelectric-type speaker 10. Please refer to FIG. 4B, in which the high-pitched speaker 122 includes two piezoelectric members 261, 262 to form a bimorph piezoelectric chip in which the two piezoelectric members 261, 262 are attached with each other. Comparing the embodiment of the high-pitched speaker 122 shown in FIG. 4B with the embodiment of the high-pitched speaker 122 shown in FIG. 4A, the sensitivity of the high-pitched speaker 122 shown in FIG. 4B is two times better than that shown in FIG. 4A. Furthermore, in this embodiment, the thickness of the piezoelectric members 261, 262 is 50 μm.

Figure 4C:
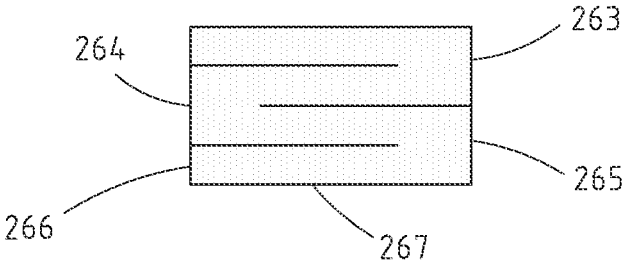
FIG. 4C is a schematic view (3) to illustrate the manufacturing process of the piezoelectric member of the piezoelectric-type speaker of the disclosure.

FIG. 4C is a schematic view (3) to illustrate the manufacturing process of the piezoelectric members 263, 264, 265, 266 of the piezoelectric-type speaker 10. Please refer to FIG. 4C, in which the high-pitched speaker 10 includes four piezoelectric members 263, 264, 265, 266, and the four piezoelectric members 263, 264, 265, 266 are attached sequentially. Three electrodes 267 are assembled between the four piezoelectric members 263, 264, 265, 266. Comparing the embodiment of the high-pitched speaker 122 shown in FIG. 4C with the embodiment of the high-pitched speaker 122 shown in FIG. 4A, it may be seen that the sensitivity of the high-pitched speaker 122 shown in FIG. 4C is four times better than that shown in FIG. 4A.

It is realized that the diameter of the piezoelectric-type speaker 10 applied for earphone is approximately at a range from 8 mm to 16 mm. Consequently, the size of the high-pitched speaker 122 is relatively restricted. Here, in order to improve the sensitivity of the piezoelectric member 260 of the high-pitched speaker 122, the impedance of the piezoelectric member 260 must be reduced. Furthermore, when the sensitivity becomes higher, the impedance becomes smaller, and the acoustic pressure becomes larger, so that the volume of the sounds being output becomes larger. Here, a low impedance earphone is provided which is easy to be driven and easy to output sounds. In this embodiment, the impedance X satisfies the equation: $X=\frac{1}{2}\pi fC$ (f: frequency, C: capacitance); that is, if the impedance is reduced, the frequency and the capacitance are increased. In other words, in order to obtain a better sensitivity, the capacitance is set, for example, as 100 nF, which means the impedance is 32Ω. For ensuring the capacitance is approximately equal to 100 nF, two layers of the piezoelectric member 260 are attached to the surface of the vibration plate 270 in 9 mm diameter, and other two layers of piezoelectric member 260 are attached to the back of the vibration plate 270, thereby forming four layers of piezoelectric member 260 to accomplish the required acoustic pressure. Furthermore, in some cases, the vibration plate 270 is connected to an amplifier to enhance the acoustic pressure.

Figure 5A:
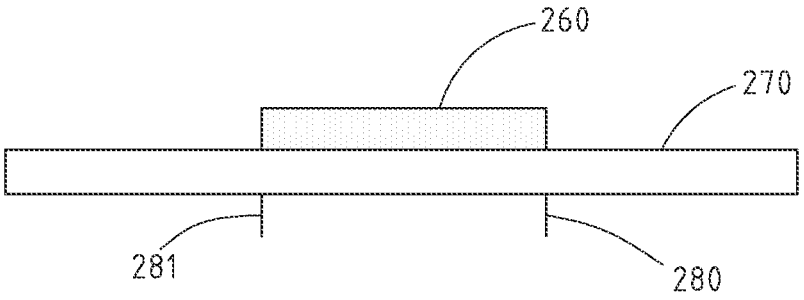
FIG. 5A is a schematic view (1) to illustrate one configuration for supporting the piezoelectric member of the piezoelectric-type speaker of the disclosure.

FIG. 5A is a schematic view (1) to illustrate one configuration for supporting the piezoelectric member 260 of the piezoelectric-type speaker 10. Please refer to FIG. 5A, in which the supporting portions 280, 281 are disposed below the vibration plate 270; the piezoelectric member 260 is disposed on the vibration plate 270. The resonant frequency is determined according to the distance between the supporting portions 280, 281. In this scenario, the distance between the supporting portions 280, 281 is approximately equal to the length of the piezoelectric member 260 (as shown in FIG. 5A). The distance between the supporting portions 280, 281 becomes larger, the resonant frequency becomes lower. Here, because the distance between the supporting portions 280, 281 are relatively shorter as compared to FIG. 5B, the resonant frequency is relatively higher. Furthermore, the area of the piezoelectric member 260 is proportional to the capacitance; that is, the larger the area of the piezoelectric member 260 is, the higher the acoustic pressure is. Additionally, the shape of the piezoelectric member 260 does not affect the performance of the acoustic pressure. In this embodiment, the piezoelectric member 260 utilized in the high-pitched speaker 122 has a larger area, so as to ensure the quality of the acoustic pressure.

Figure 5B:
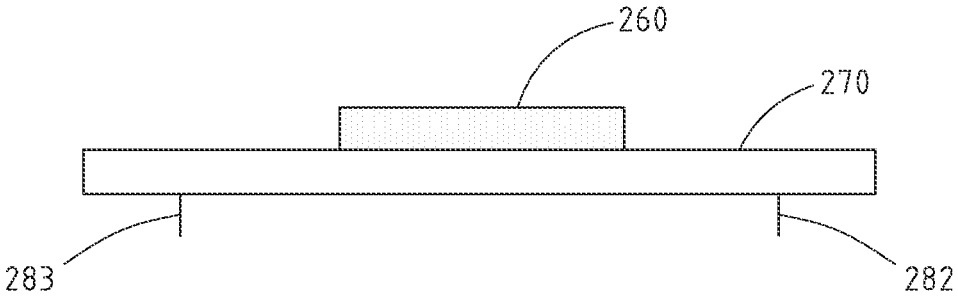
FIG. 5B is a schematic view (2) to illustrate another configuration for supporting the piezoelectric member of the piezoelectric-type speaker of the disclosure.

FIG. 5B is a schematic view (2) to illustrate another configuration for supporting the piezoelectric member 260 of the piezoelectric-type speaker 10. Please refer to FIG. 5B, in which the piezoelectric member 260 is disposed on the vibration plate 270. Again, the resonant frequency is determined according to the distance between the supporting portions 282, 283. In contrast to FIG. 5A, in FIG. 5B, since the distance between the supporting portions 282, 283 is larger than the length of the piezoelectric member 260, the resonant frequency in FIG. 5B is lower than that in FIG. 5A.

Figure 5C:
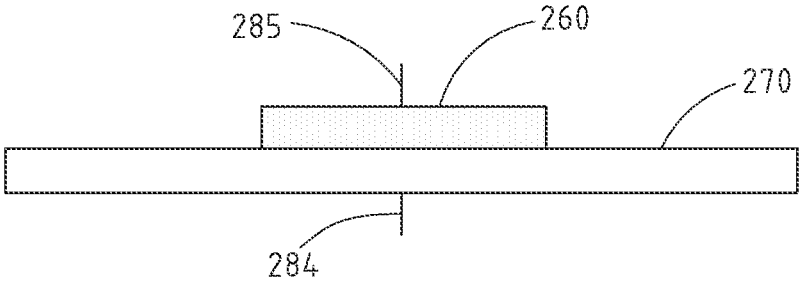
FIG. 5C is a schematic view (3) to illustrate yet another configuration for supporting the piezoelectric member of the piezoelectric-type speaker of the disclosure.

FIG. 5C is a schematic view (3) to illustrate yet another configuration for supporting the piezoelectric member 260 of the piezoelectric-type speaker 10. Please refer to FIG. 5C, in which the piezoelectric member 260 is disposed on the vibration plate 270, and the resonant frequency is determined according to the distance between the supporting portions 284, 285. Here, the supporting portions 284, 285 are respectively supported to the piezoelectric member 260 and the vibration plate 270; that is, the supporting portions 284, 285 are arranged at the same line. In contrast to FIG. 5A and FIG. 5B, the resonant frequency in FIG. 5C is the lowest.

Figure 6A:
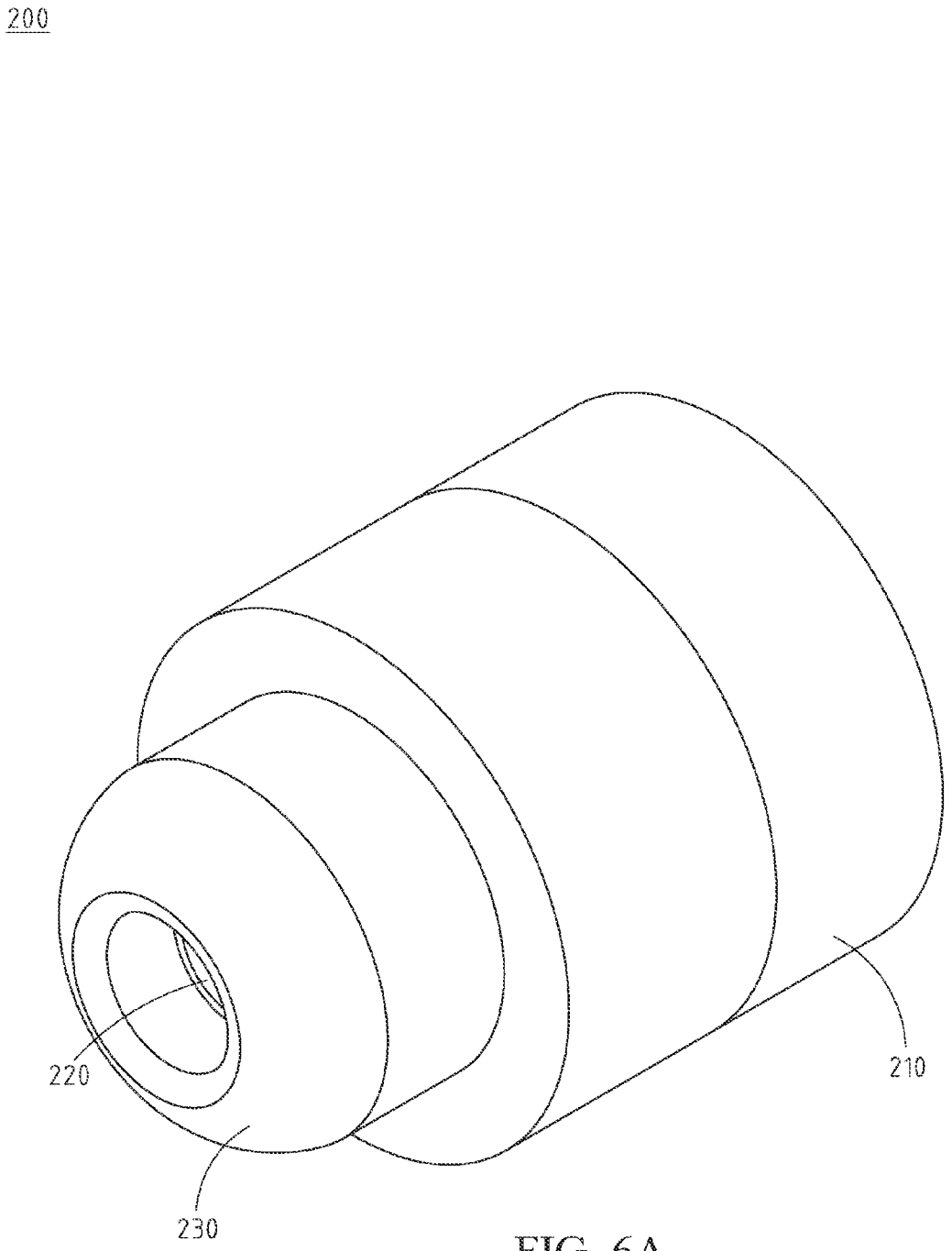
FIG. 6A is a perspective view to illustrate an earphone utilizing the piezoelectric-type speaker of the disclosure.
Figure 6B:
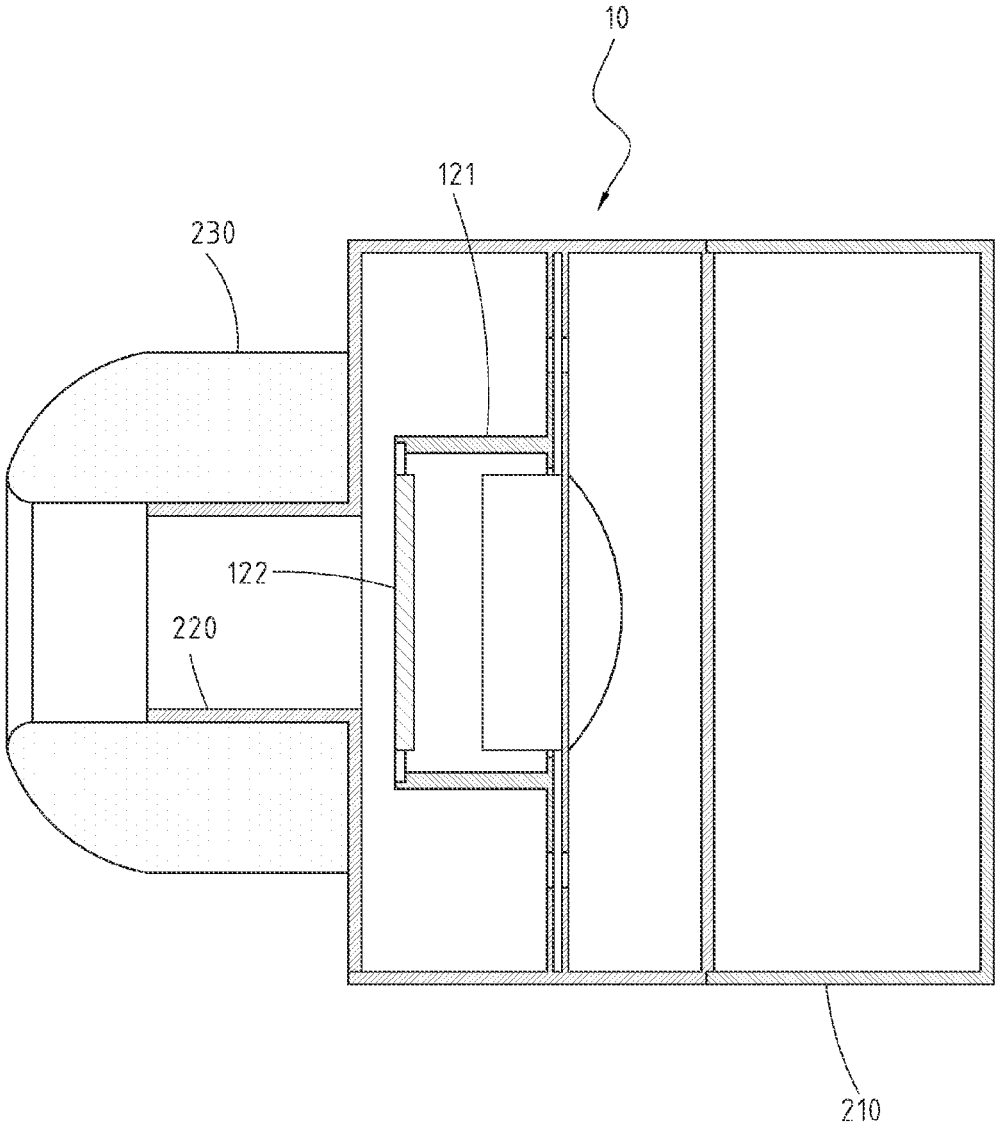
FIG. 6B is a sectional view to illustrate the earphone utilizing the piezoelectric-type speaker of the disclosure.

FIG. 6A is a perspective view to illustrate an earphone 200 utilizing the piezoelectric-type speaker 10, and FIG. 6B is a sectional view to illustrate the earphone 200 utilizing the piezoelectric-type speaker 10. Please refer to FIG. 6A and FIG. 6B, in which an earphone 200 with an earbud profile is provided. The earphone 200 includes a casing 210 formed as a cylinder structure. An outer cylinder 220 is protruded from one of two ends of the casing 210 and formed as a cylinder structure. The outer diameter of the outer cylinder 220 is smaller than that of the casing 210. An ear cushion 230 is sleeved on the outer cylinder 220. The piezoelectric-type speaker 10 shown in FIG. 2A is disposed in the casing 210, and the high-pitched speaker 122 of the piezoelectric-type speaker 10 is adjacent to the outer cylinder 220. Additionally, the piezoelectric-type speaker 10 is disposed in the casing 210 and adjacent to the ear cushion 230. The piezoelectric-type speaker 10 is enclosed by the casing 210 and the ear cushion 230. Here, as described, the high-pitched speaker 122 is sealed, but the acoustic pressure is not reduced. Consequently, the sound quality reduction problem caused by the leaking of the air from the ear cushion 230 can be improved. Furthermore, due to the low-pitched sounds being output through the low-pitched adjusting orifices 111, 112 and the through holes 141, 142, the low-pitched sounds leaking from the ear cushion 230 are reduced. When the earphone 200 is plugged into the ear of the user, the tympanic membrane of the user is adjacent to the high-pitched speaker 122, and the high-pitched sounds output by the high-pitched speaker 122 of the piezoelectric-type speaker 10 can be output near the tympanic membrane; which means a small space can be provided between the high-pitched speaker 122 and the tympanic membrane, so the high-pitched speaker 122 can provide high-pitched sounds clearly, with high quality.

Figure 7:
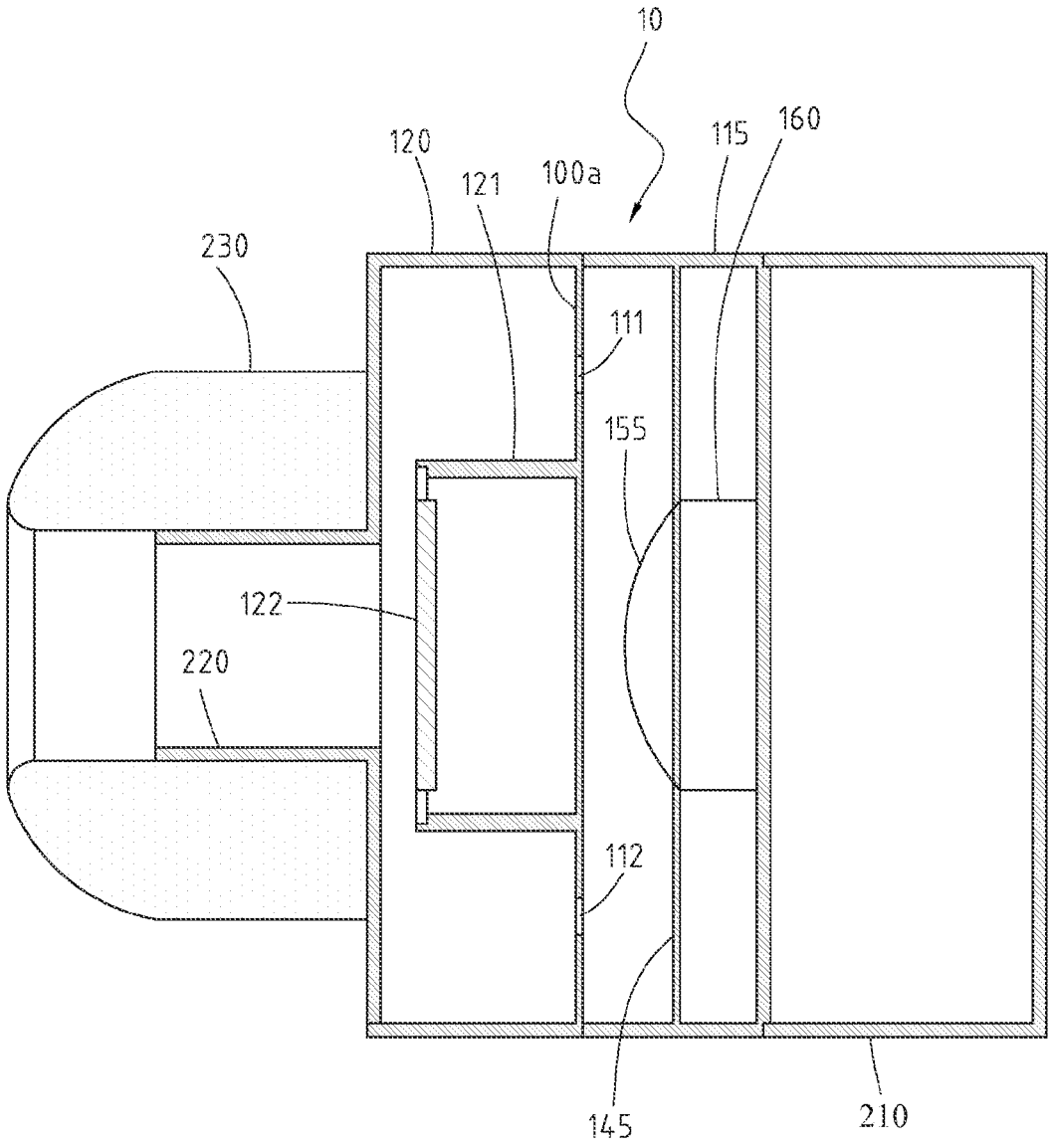
FIG. 7 is a sectional view to illustrate another earphone utilizing the piezoelectric-type speaker of the disclosure.

FIG. 7 is a sectional view to illustrate another earphone 201 utilizing the piezoelectric-type speaker 10 of the disclosure. Please refer to FIG. 7, in which one earphone 201 with an earbud profile is provided. The earphone 201 includes a casing 210 formed as a cylinder structure. The casing 210 includes an upper casing 120 and a lower casing 115. The piezoelectric-type speaker 10 shown in FIG. 2A is disposed in the casing 210. The frame 145 is disposed at the inner wall of the lower casing 115, the film structure 155 is disposed at the frame 145, and the direction where the film structure 155 is assembled to shown in FIG. 7, is opposite to that shown in FIG. 6B.

In this embodiment, because the low-pitched sounds enter into the upper casing 120 through the low-pitched adjusting orifices 111, 112 and the through holes 141, 142, more fundamental frequencies (F0) can be provided and tuned lower to be at the low-pitched frequency band. That is, because the low-pitched sounds pass through the through holes 141, 142 and the low-pitched adjusting orifices 111, 112, the low-pitched sounds cut off sounds whose frequency are higher than 5 kHz much easier; that is, the volume of the low-pitched sounds output by the film structure 155 and passing through the through holes 141, 142 and the low-pitched adjusting orifices 111, 112 becomes smaller near the crossing point, thus the piezoelectric-type speaker 10 of the disclosure can output clear sounds within a wider acoustic band.

Figure 8A:
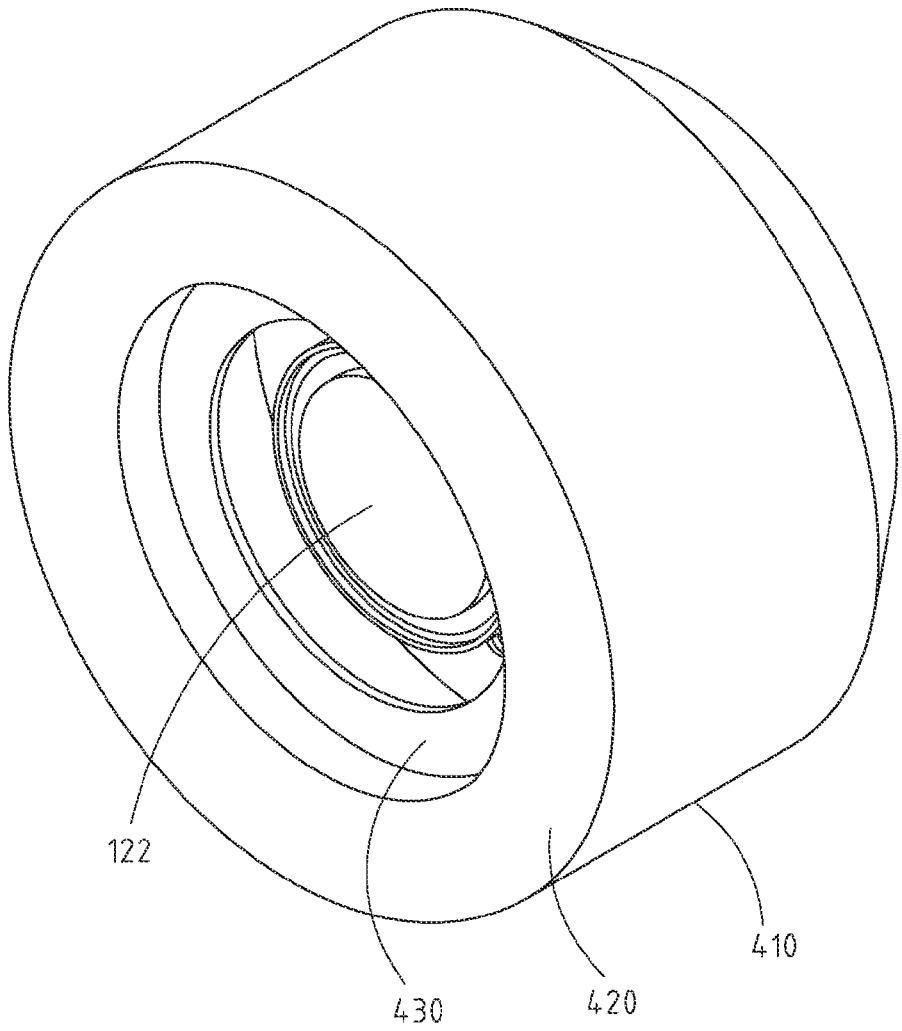
FIG. 8A is a perspective view to illustrate a headphone utilizing the piezoelectric-type speaker of the disclosure.
Figure 8B:
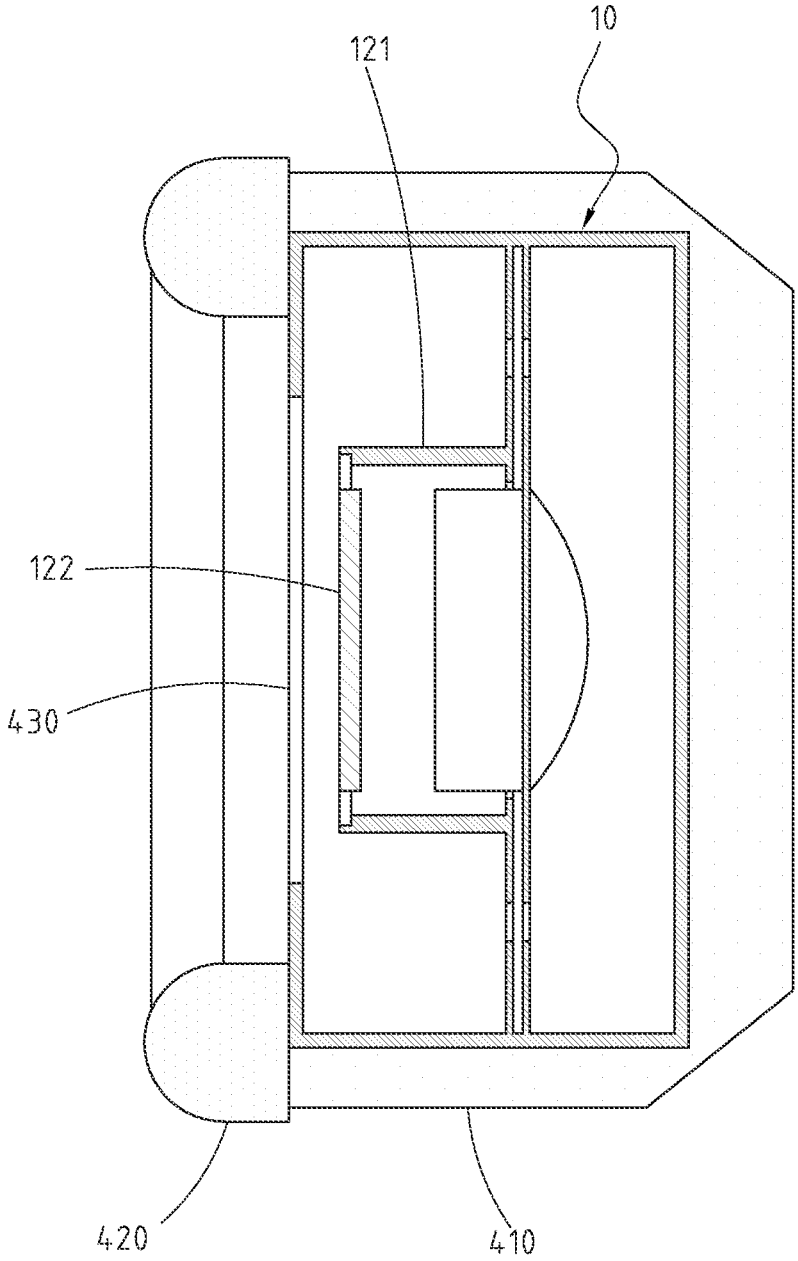
FIG. 8B is a sectional view to illustrate the headphone utilizing the piezoelectric-type speaker of the disclosure.

FIG. 8A is a perspective view to illustrate a headphone 400 utilizing the piezoelectric-type speaker 10, and FIG. 8B is a sectional view thereof. Please refer to FIG. 8A and FIG. 8B, in which the headphone 400 includes a shell 410 formed as a cap-like structure. The length of the shell 410 along the lengthways thereof is equal to 30 mm. The piezoelectric-type speaker 10 shown in FIG. 2A is disposed in the shell 410. Additionally, a buffering cushion 420 is disposed at one side of the shell 410. The buffering cushion 420 is approximately formed as an annular structure. The buffering cushion 420 is disposed opposite to the supporting base 121. A separating film 430 is disposed between the shell 410 and the buffering cushion 420. The separating film 430 is made of polyurethane and corresponds to the opening of the shell 410.

When the headphone 400 is worn by the user, the tympanic membrane of the user is adjacent to the high-pitched speaker 122, and the high-pitched sounds output by the high-pitched speaker 122 of the piezoelectric-type speaker 10 can be output near the tympanic membrane; which means a small space can be provided between the high-pitched speaker 122 and the tympanic membrane, thereby the high-pitched speaker 122 providing high-pitched sounds clearly, with high quality.

While the disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A piezoelectric-type speaker, provided for converting electrical signals into sounds capable of being heard by a human's ear, the piezoelectric-type speaker comprising:

a housing;

a separating portion, disposed at the housing, the separating portion being provided for separating interior spaces of the housing, wherein the separating portion comprises a plurality of low-pitched adjusting orifices disposed at two sides of the supporting base;

a frame, fastened at an inner wall of the housing and paralleled to the separating portion, wherein a plurality of through holes are formed on the frame, and the through holes respectively corresponds to the low-pitched adjusting orifices;

a supporting base, disposed at the housing, one of two ends of the supporting base being fastened with the separating portion;

a high-pitched speaker, formed by at least one piezoelectric member, and the high-pitched speaker being supported by the other end of the supporting base; and a dynamic low-pitched speaker, disposed in the housing, the dynamic low-pitched speaker being disposed at the separating portion and opposite to the high-pitched speaker.

2. The piezoelectric-type speaker according to claim 1, wherein the housing comprises a lower housing and an upper housing separated from each other, the frame is disposed at the inner wall of the lower housing.

3. The piezoelectric-type speaker according to claim 1, wherein the dynamic low-pitched speaker comprises a film structure and a low-pitched speaker unit, the film structure and the low-pitched speaker unit are disposed at the separating portion.

4. The piezoelectric-type speaker according to claim 3, wherein the low-pitched speaker comprises a voice coil, a damper and a magnet, the magnet is disposed on the film structure, one of two ends of the damper is connected to the frame, and the other end of the damper is connected to the voice coil.

5. The piezoelectric-type speaker according to claim 1, wherein the dynamic low-pitched speaker and the high-pitched speaker are sealed in the housing.

6. The piezoelectric-type speaker according to claim 1, wherein the high-pitched speaker further comprises a vibration plate attached to the at least one piezoelectric member.

7. The piezoelectric-type speaker according to claim 6, wherein the high-pitched speaker further comprises a plurality of supporting portions supporting the vibration plate, the at least one piezoelectric member or the combination thereof.

* * * * *